US009505055B2

(12) United States Patent
Gravier et al.

(10) Patent No.: US 9,505,055 B2
(45) Date of Patent: Nov. 29, 2016

(54) METHOD FOR REMOVING A PART MADE OF A MATERIAL HAVING A GLASS-TRANSITION TEMPERATURE FROM A MOLD

(75) Inventors: Sébastien Gravier, Vizille (FR); Georges Kapelski, Vaulnaveys le Haut (FR); Jean-Jacques Blandin, Champ Pres Froges (FR); Charles Josserond, Villard-bonnot (FR)

(73) Assignees: UNIVERSITE JOSEPH FOURIER, Saint Martin d'heres (FR); INSTITUT POLYTECHNIQUE DE GRENOBLE, Grenoble (FR); CENTRE NATIONAL DE LA RECHERCHE SCIENTIFIQUE (CNRS), Paris (FR)

( * ) Notice: Subject to any disclaimer, the term of this patent is extended or adjusted under 35 U.S.C. 154(b) by 108 days.

(21) Appl. No.: 14/124,854

(22) PCT Filed: Jun. 1, 2012

(86) PCT No.: PCT/EP2012/060358
§ 371 (c)(1),
(2), (4) Date: Feb. 27, 2014

(87) PCT Pub. No.: WO2012/168147
PCT Pub. Date: Dec. 13, 2012

(65) Prior Publication Data

US 2014/0166228 A1 Jun. 19, 2014

(30) Foreign Application Priority Data

Jun. 9, 2011 (FR) ..... 11 55076

(51) Int. Cl.

| | |
|---|---|
| ***B22D 17/22*** | (2006.01) |
| ***B22D 25/06*** | (2006.01) |
| ***B22D 27/04*** | (2006.01) |
| ***B22D 29/00*** | (2006.01) |
| ***B22D 30/00*** | (2006.01) |

(52) U.S. Cl.
CPC ..... *B22D 25/06* (2013.01); *B22D 17/2236* (2013.01); *B22D 27/04* (2013.01); *B22D 29/00* (2013.01); *B22D 30/00* (2013.01)

(58) Field of Classification Search
CPC .. B22D 17/2236; B22D 25/06; B22D 27/04; B22D 29/00; B22D 30/00
USPC ..... 164/124, 344, 151.4, 154.6
See application file for complete search history.

(56) References Cited

U.S. PATENT DOCUMENTS

| | | | |
|---|---|---|---|
| 2,974,379 A | 3/1961 | Mills | |
| 6,308,765 B1 * | 10/2001 | Grinberg et al. | 164/34 |

FOREIGN PATENT DOCUMENTS

| | | |
|---|---|---|
| DE | 198 30 025 | 1/2000 |
| DE | 10 2006 057660 | 6/2008 |
| EP | 0 895 823 | 2/1999 |
| EP | 0 941 788 | 9/1999 |
| KR | 2009-0126403 | 12/2009 |
| WO | 96/22852 | 8/1996 |

* cited by examiner

*Primary Examiner* — Kevin P Kerns
(74) *Attorney, Agent, or Firm* — Clark & Brody

(57) ABSTRACT

A method for removing a part from a mold and to a machine for molding the part, the part made of a material having a glass-transition temperature and a melting temperature that is higher than the glass-transition temperature, and which is shaped in the cavity of a mold, includes at least two mold portions defining the shaping cavity therebetween. The mold is at a temperature between the glass-transition temperature and the melting temperature. The method includes opening the mold by spacing apart the mold portions, locally spraying a cooling gas toward the part remaining in a portion of the mold using at least one nozzle, and, after a predetermined time period following the start of spraying the gas, ejecting the part from the portion of the mold, the time period being such that the part reaches a temperature that is lower than the glass-transition temperature thereof.

5 Claims, 3 Drawing Sheets

METHOD FOR REMOVING A PART MADE OF A MATERIAL HAVING A GLASS-TRANSITION TEMPERATURE FROM A MOLD

FIELD OF THE INVENTION

The present invention relates to the field of the shaping of parts made of an amorphous or vitreous material, i.e. a material that has a glass transition temperature, particularly parts made of metallic glass.

BACKGROUND ART

At the present time, when a part is shaped in a mold, whether this be a part obtained in an injection mold or in a hot forming mold, the mold is cooled, the mold is opened to allow the part to cool, and an ejector is used to eject the part from the mold segment in which this part remains as the mold is opened. The cooling of the mold and, therefore, of the part, needs to be determined in such a way that the part, and possibly also the mold, is/are not damaged during the ejection.

For example, patent DE 198 30 025 describes a mold, a segment of which is provided with cooling passages.

Patents EP 0 941 788, U.S. Pat. No. 2,974,379 and WO 96/22852 describe molding machines equipped with devices that clean the parting lines and the cavities of the molds.

Patent DE 10 2006 057660 describes a molding machine in which such a cleaning device can be used to cool the molded part.

All of the patents mentioned hereinabove relate to the molding of metals, which have a solid/liquid transition temperature and the volume of which reduces sharply when, in the closed mold, they make the transition from the liquid state to the solid state, making removal from the mold easier.

Removal from a mold and, possibly, earlier shaping of parts made of a material that has a glass transition temperature and a melting point higher than its glass transition temperature present real difficulties which cannot be overcome by using molding machines of the prior art above.

Particularly when the parts are made of a metallic glass and are of small size, particularly smaller than one centimeter cubed ($cm^3$), one difficulty stems from the need to obtain rapid cooling in order to prevent the material from crystallizing. Another difficulty stems from the risk of deformation of the part resulting from the effects of the part becoming wedged in the mold and from the forces applied by the ejector, these being due in particular to the difference between the coefficient of expansion of the mold and that of the part and to the fact that the material of which the part is made does not undergo a sharp variation in volume as it cools. Control over the shaping and mold release timing cycles also presents difficulties.

SUMMARY OF THE INVENTION

It is an object of the present invention to propose a solution notably to the above difficulties.

It proposes a method for removing from a mold a part made of a material that has a glass transition temperature and a melting point higher than its glass transition temperature, which is shaped in a cavity of a mold comprising at least two mold segments between them delimiting this shaping cavity, in which method the mold is at a temperature comprised between said glass transition temperature and said melting point.

The method proposed involves an opening of the mold by parting said mold segments, the part in the cavity of the mold being at a temperature comprised between said glass transition temperature and said melting point; a local spraying of a cooling gas toward the part that has remained in one mold segment; and, after a determined delay following the start of the spraying of the gas, the ejecting of the part from this segment of the mold, this determined delay being such that the part reaches a temperature below its glass transition temperature.

The method may involve stopping the spraying of the gas before ejecting the part.

The method may involve ejecting the part while the gas is being sprayed.

The method may involve keeping the mold at a temperature comprised between the glass transition temperature and the melting point of the material of which the part is made.

It also proposes a method for shaping a part made of a material that has a glass transition temperature and a melting point higher than its glass transition temperature, which involves the aforementioned removal method and involving before that, bringing a quantity of material to a temperature comprised between its glass transition temperature and its melting point and injecting this quantity of material in this state into said shaping cavity when the mold segments are coupled together so as to shape the material to the shape of the shaping cavity.

It also proposes a method for shaping a part made of a material having a glass transition temperature and a melting point higher than its glass transition temperature, which involves the aforementioned removal method and involving, prior to that, bringing a quantity of material into a hollow portion of one of the mold segments and coupling the mold segments in order by die stamping to shape the material to the shape of the shaping cavity.

It also proposes a molding machine which comprises a mold comprising at least a first and a second mold segment between them, when coupled together, delimiting a shaping cavity for shaping a part made of a material that has a glass transition temperature and a melting point higher than its glass transition temperature, a means for keeping the mold at a temperature comprised between said glass transition temperature and said melting point, at least one ejection means for extracting the part from one of said mold segments, at least one nozzle for spraying a gas that has at least one outlet orifice, this spray nozzle being mounted on a movement means able to move the nozzle between a withdrawn position in which the mold segments can be coupled together or parted, and a forward position in which, when the mold segments are parted, the outlet orifice of the nozzle is positioned in the direction and in the vicinity of the part that has remained in one mold segment, and a control means for commanding the opening of the mold, then the bringing of the nozzle into said forward position and the injection of the cooling gas, then the ejection of the part after a determined delay following the start of the spraying of the gas, this determined delay being such that the part reaches a temperature below its glass transition temperature.

A molding machine according to the present invention will now be described by way of nonlimiting example, illustrated by the drawing in which:

BRIEF DESCRIPRION OF THE DRAWINGS

DETAILED DESCRIPTION OF THE INVENTION

There is a desire to shape and to obtain a part P made of a material having a glass transition temperature $T_V$ and a melting point $T_F$ higher than its glass transition temperature $T_V$, for example made of a glass such as an oxide glass, a metallic glass or a polymer. Below its glass transition temperature, the material is solid. Between its glass transition temperature and its melting point $T_F$, the material is malleable. Above its melting point $T_F$, the material is liquid.

Figure 1:
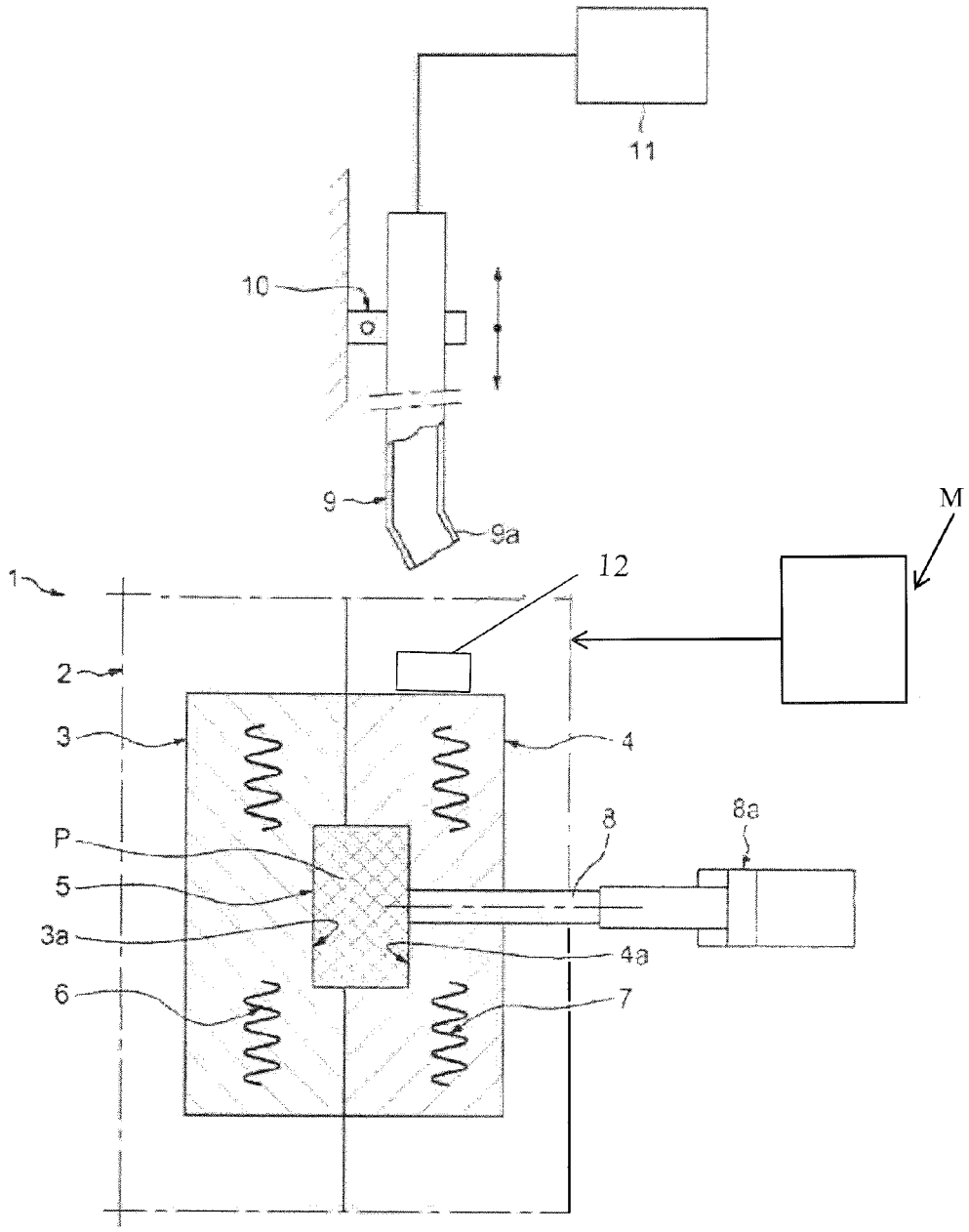
FIG. 1 depicts a partial cross section through the molding machine, with the mold of this machine being closed.
Figure 2:
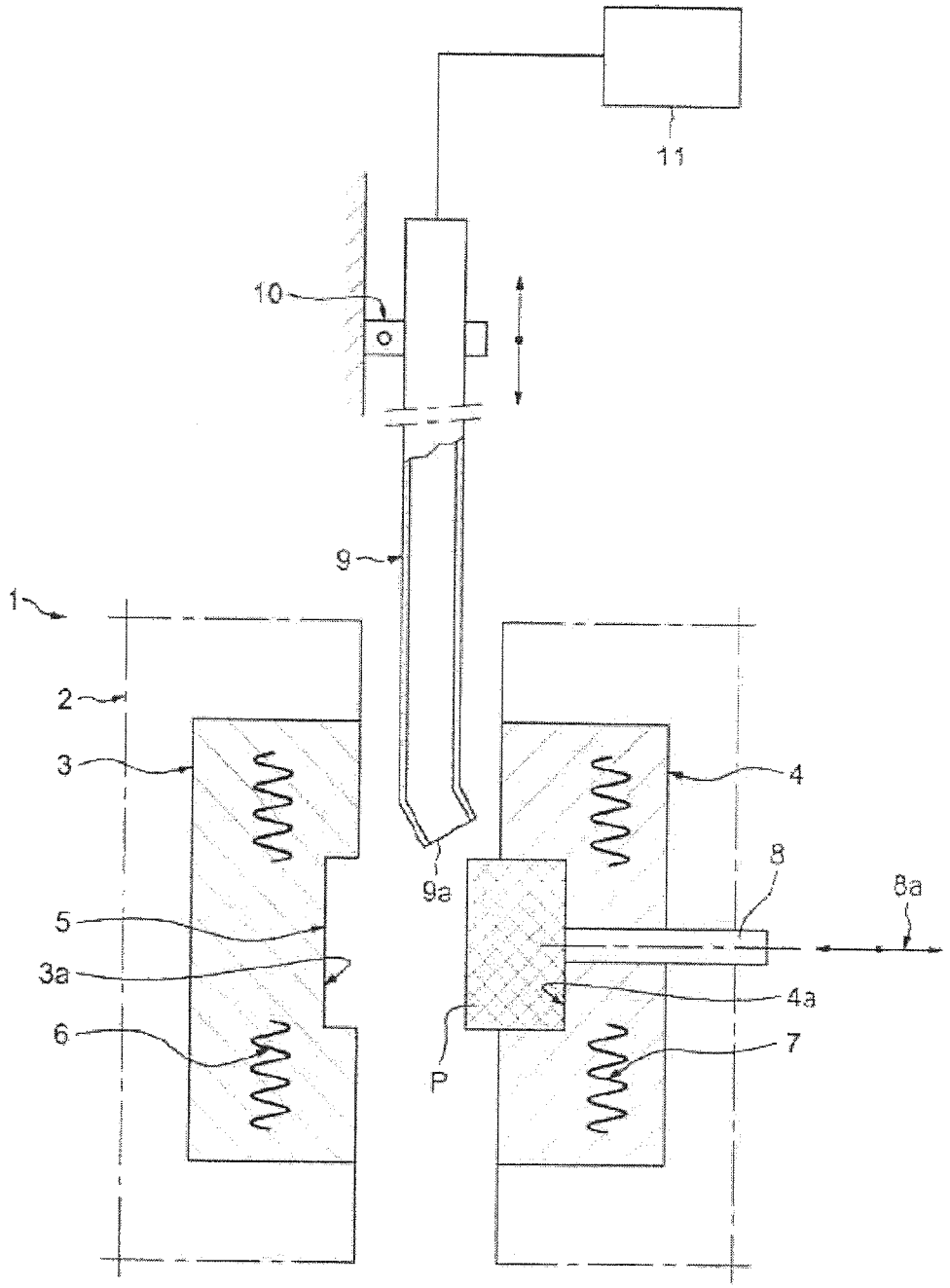
FIG. 2 depicts a partial cross section through the molding machine with the mold of this machine being open.

As illustrated in FIGS. 1 and 2, a molding machine 1 comprises a mold 2 formed for example of two mold segments 3 and 4 which between them delimit a shaping cavity 5. This cavity 5 may be delimited by hollow parts 3*a* and 4*a* formed in the mold segments 3 and 4. The mold segments 3 and 4 are equipped with heating means 6 and 7 formed, for example, of resistive electric elements.

For example, the mold segment 4 is equipped with a sliding ejector 8 that can be actuated by an actuating cylinder 8*a*.

The molding machine 1 further comprises a nozzle 9 for spraying a cooling gas, which nozzle is borne by a movement mechanism 10, for example one that allows translational or rotational movement.

Under the effect of the movement mechanism 10, the nozzle 9 can be moved between a withdrawn position in which the mold segments 3 and 4 can be coupled together (FIG. 1) or parted (FIG. 2) and a forward position in which, with the mold segments 3 and 4 parted (FIG. 2), the free end portion of the nozzle 9 can be introduced inbetween the mold segments 3 and 4 as far as a position such that its end orifice 9*a* is a short distance from and oriented toward, for example, the hollow portion 4*a* of the mold segment 4.

The nozzle 9 is connected to a source 11 of a cooling gas.

The molding machine 1 can operate and be used as follows.

As illustrated in FIG. 1, the mold segments 3 and 4 are coupled together and a part P is shaped in the cavity 5. The mold segments 3 and 4 are at a shaping temperature comprised between the glass transition temperature $T_V$ and the melting point $T_F$ of the material of which the part P is made.

In an alternative form of embodiment, the part P may be the result of a quantity of material being injected into the cavity 5 of the closed mold 2, this quantity of material having been brought beforehand to a temperature comprised between the glass transition temperature $T_V$ and the melting point $T_F$ of this material.

According to another alternative form of embodiment, the part P may result from a die stamping in the cavity 5 of a quantity of material through the movement toward one another of the mold segments 3 and 4.

The nozzle 9 is in its withdrawn position.

To remove the part P from the mold, the procedure may be as follows.

The mold 2 is opened by parting the mold segments 3 and 4. Because of its shape and because of the corresponding shape of the cavity 5, the part P remains in the hollow portion 4*a* of the mold segment 4, while still being able to be ejected therefrom.

Next, the nozzle 9 is brought into its forward position. The position illustrated in FIG. 2 is reached.

Next, the nozzle 9 is supplied with a pressurized cooling gas from the source 11 so that this gas, which is neutral with respect to the material of which the part P is made, is sprayed toward the part P, onto the uncovered portion thereof and possibly in part against the surrounding zone of the mold segment 4, so as to bring about a local cooling which cools the part P down to a temperature below its glass transition temperature $T_V$ so that it becomes more rigid.

In an alternative form of embodiment, the supply of gas to the nozzle 9 may begin before the nozzle reaches its forward position.

Next, the ejector 8 is actuated under the effect of the actuating cylinder 8*a* so as to extract the part P from the hollow portion 4*a* of the mold segment 4.

The mold removal operations described hereinabove can be performed without switching off the heating means 6 and 7 so that after a possible cleaning and withdrawal of the nozzle 9, the mold 2 is immediately ready to shape a new part P.

Performance of the above mold-removal steps may be controlled for temperature and for time. This control may depend on the shape and size of the part P, on the temperature of the mold 2 and on the desired cooling rate for the part P.

The temperature of the mold 2 is comprised between the glass transition temperature $T_V$ and the melting point $T_F$ of the material of which the part P is made so that the part P is sufficiently malleable while maintaining the amorphous nature of the material of which it is made, i.e. without causing the material to crystallize. The temperature of the mold 2 can be controlled using a feedback loop that includes a temperature sensor 12 (FIG. 1) judiciously positioned on the mold 2.

It is possible to set a temperature and a speed or flow rate for the cooling gas through the end orifice 9*a* of the nozzle 9, a time for which cooling gas is sprayed by this nozzle 9 at the end of which the ejector 8 will be actuated, or a time separating the start of this spraying from the moment the ejector 8 is actuated.

The temperature that the part P attains at the moment of ejection is below the glass transition temperature $T_V$ of the material of which the part P is made so that the part has become rigid. Thus, the part P maintains its shape and the ejector 8 does not deform it as it ejects it.

For example, if the part P is made of a magnesium-based metallic glass, for example of composition $Mg_{65}Cu_{25}Gd_{10}$ (the composition being given in atomic percentages), the temperature of the mold 2 may be comprised between 140° C. and 430° C. If the part is made of a zirconium-based metallic glass, for example of composition $Zr_{52.5}Cu_{27}Al_{10}Ni_8Ti_{2.5}$ (composition indicated in atomic percentages), the temperature of the mold 2 may be comprised between 400° C. and 600° C. The temperature of the cooling gas, for example nitrogen, may be comprised between −195° C. and 20° C. The space of time separating the start of the spraying of the cooling gas and the moment that the ejector 8 is actuated may be comprised between 0.1 second and 10 seconds.

Figure 3:
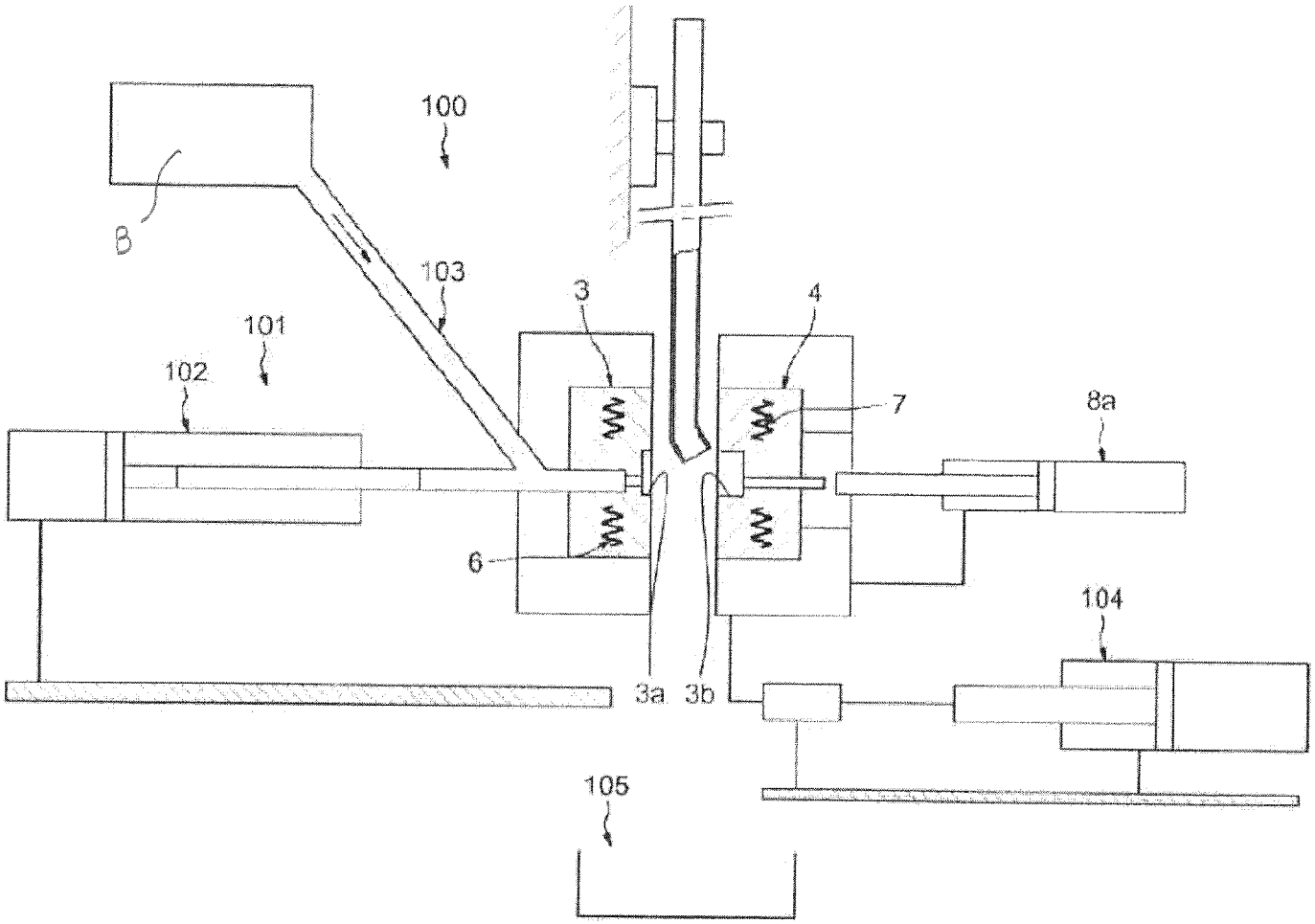
FIG. 3 depicts an injection machine including the molding machine.

According to an alternative form of embodiment illustrated in FIG. 3, an injection machine 100 comprises the molding machine 1 in a position such that the parting line of the mold segments 3 and 4 is positioned vertically.

The injection machine 100 further comprises injection apparatus 101, associated with the mold segment 3 and allowing a quantity of material B to be injected into the shaping cavity 5 when the mold 2 is closed, for example using a piston plunger 102. Feed apparatus 103 is associated with the injection apparatus 101 with a view to successively placing a quantity of material into the canal of the plunger 102.

The injection machine 100 also comprises a mechanism 104 allowing the mold segment 4 to be moved horizontally with respect to the mold segment 3.

The injection machine 100 also comprises a collecting tray 105 placed below the parting line of the mold segments 3 and 4 to collect the parts P after they have been ejected and removed from the mold as described hereinabove.

According to another alternative form of embodiment, a die stamping machine may comprise the molding machine 1 in a position such that the parting line of the mold segments 3 and 4 is positioned horizontally, the mold segment 3 being placed above the mold segment 4.

The die stamping machine may comprise a mechanism that allows the mold segments 3 and 4 to be moved vertically relative to one another.

This die stamping machine may operate as follows.

With the mold 2 open and at the desired temperature, a mechanism may place a volume or pellet of material B in the hollow portion 4*a* of the mold segment 4.

Next, the vertical-movement mechanism may bring the mold segments 3 and 4 closer together until the mold 2 is completely closed, so as to shape the volume or pellet of material B to the shape of the shaping cavity 5.

Next, the vertical-movement mechanism may part the mold segments 3 and 4 in order to open the mold 2.

The steps of placing the nozzle 9, spraying a cooling gas, demolding and ejecting the shaped part P from the shaping cavity 5 can then be carried out as described hereinabove.

According to an alternative form of embodiment, several nozzles 9 the outlet orifices 9*a* of which may be arranged at the periphery of the part P so as to cool the latter may be provided.

Of course, the various operations, steps and conditions described for molding the part P and removing it from the mold may be controlled and carried out under the effect of a programmed electronic control means M (FIG. 1) that commands and controls the molding machine 1 and the accessories thereof.

The present invention is not restricted to the examples described hereinabove. Many other alternative forms of embodiment are possible, without departing from the scope of the invention.

The invention claimed is:

1. A method for removing from a mold a part made of a material that has a glass transition temperature and a melting point higher than said glass transition temperature, which is shaped in a cavity of a mold comprising:

providing at least two mold segments (3, 4) having a shaping cavity (5) therebetween, the mold at a temperature between said glass transition temperature and said melting point;

opening of the mold by parting said at least two mold segments (3, 4);

spraying a cooling gas toward the part that remains in one of the at least two mold segments;

and, after a delay following the start of the spraying of the gas, ejecting the part from the one mold segment, the delay being such that the part reaches a temperature below said glass transition temperature.

2. The method as claimed in claim 1, involving stopping the spraying of the cooling gas before ejecting the part.

3. The method as claimed in claim 1, involving ejecting the part while the cooling gas is being sprayed.

4. A method for shaping a part made of a material that has a glass transition temperature and a melting point higher than said glass transition temperature, the method comprising the removal method of claim 1 and further comprising a step prior to the removal step of bringing a quantity of the material to a temperature between said glass transition temperature and said melting point and injecting the quantity of material into said shaping cavity when the at least two mold segments (3, 4) are coupled together so as to shape the material to the shape of the shaping cavity (5).

5. A method for shaping a part made of a material having a glass transition temperature and a melting point higher than said glass transition temperature, the method comprising the removal method of claim 1 and further comprising a step prior to the removal step of bringing a quantity of the material into a hollow portion of one of the at least two mold segments and coupling the at least two mold segments (3, 4) in order by die stamping to shape the material to the shape of the shaping cavity (5).

* * * * *